United States Patent [19]

Poper et al.

[11] 4,290,904

[45] Sep. 22, 1981

[54] TRANSPARENT SOAP

[75] Inventors: Maxwell H. Poper, Westminster, Calif.; Eric Jungermann, Phoenix, Ariz.

[73] Assignee: Neutrogena Corporation, Los Angeles, Calif.

[21] Appl. No.: 211,557

[22] Filed: Dec. 1, 1980

[51] Int. Cl.[3] ..... C11D 9/30; C11D 9/48; C11D 10/06; C11D 17/00

[52] U.S. Cl. ..... 252/118; 252/117; 252/132; 252/134; 252/153; 252/548; 252/DIG. 16

[58] Field of Search ..... 252/108, 110, 117, 118, 252/122, 132, 134, 174, 153, 548, DIG. 16

[56] References Cited

U.S. PATENT DOCUMENTS

| | | | |
|---|---|---|---|
| 2,697,113 | 12/1954 | Lundsted | 106/168 X R |
| 2,774,735 | 12/1956 | Becher | 252/117 |
| 2,820,768 | 1/1958 | Fromont | 252/118 |
| 2,835,604 | 5/1958 | Aronberg | 106/243 |
| 2,970,116 | 1/1961 | Kelly et al. | 252/368 |
| 3,155,624 | 11/1964 | Kelly | 252/122 |
| 3,562,167 | 2/1971 | Kamen et al. | 252/121 |
| 3,793,214 | 2/1974 | O'Neill et al. | 252/117 |
| 3,864,272 | 2/1975 | Toma et al. | 252/125 |
| 3,903,008 | 9/1975 | Deweever et al. | 252/118 |
| 3,926,828 | 12/1975 | O'Neill et al. | 252/117 |
| 3,969,259 | 7/1976 | Lages | 252/107 |
| 4,165,293 | 8/1979 | Gordon | 252/118 |

OTHER PUBLICATIONS

"Data on . . . QUADROL" publication of Wyandotte Chemical Corp., Wyandotte, Michigan, Dec. 1, 1959, 6 pp.

*Primary Examiner*—Dennis L. Albrecht
*Attorney, Agent, or Firm*—Nilsson, Robbins, Dalgarn, Berliner, Carson & Wurst

[57] ABSTRACT

A transparent low alkalinity bar soap based on a tetrakis (hydroxyalkyl) ethylene diamine having the formula

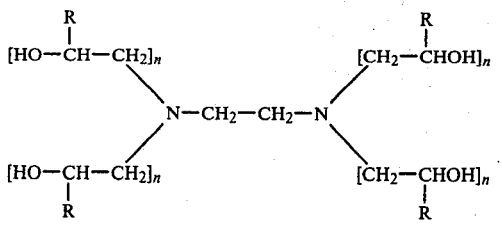

wherein R is hydrogen or an alkyl group having one to four carbon atoms and n is one to four. The soap is prepared by adding the tetrakis (hydroxyalkyl) ethylene diamine to a mixture of caustic soda, saponifiable fatty oil, water and a polyhydric alcohol, either before or after saponification, followed by addition of one or more superfatting agents as well as other ingredients designed to affect the properties of the bar for humectant, surfactant and perfuming purposes.

34 Claims, No Drawings

TRANSPARENT SOAP

FIELD OF THE INVENTION

The field of art to which the invention pertains includes the field of solid transparent detergent compositions and to methods for making the same.

BACKGROUND AND SUMMARY OF THE INVENTION

The term "transparent soap" as used herein encompasses soaps having a wide degree of color and gloss but which are sufficiently transluscent so that one can effectively see through a toilet sized bar. For example, if 14 point type can be read through a $\frac{1}{4}''$ bar of soap, the soap can be regarded as transparent.

A variety of transparent soaps have been formulated. A common technique has been based upon the addition of a polyhydric alcohol such as glycerol, glycol, sugar or the like to a "neat soap" or semi-boiled soap, or to soap prepared by the cold process technique. Another method consists of dissolving soap in alcohol to remove saline impurities and then distilling off most of the alcohol. U.S. Pat. No. 3,562,167 describes a transparent soap formed from a combination of soap, polyhydric alcohol and, as a surface active agent, a polyalkoxy ether of an alkylphenol. U.S. Pat. No. 3,903,008 describes the formulation of a transparent soap by the combination of soap, polyhydric alcohol and an amphoteric imidazolene detergent. U.S. Pat. Nos. 3,793,214 and 3,926,808 describe transparent soaps produced using branched chain fatty acids. U.S. Pat. No. 3,864,272 describes the use of rather complicated, elaborate mechanical methods of working the soap.

A method of formulating a transparent soap is disclosed in U.S. Pat. No. 2,820,768 where a sodium soap made from tallow, coconut oil and castor is mixed with a triethanolamine soap of stearic acid and oleic acid and an excess of the amine. Small changes in the amount of amine component or of the relative proportions of certain ingredients leads to loss of transparency.

Low alkalinity is a desirable feature of toilet soaps and some current transparent soaps possess this feature. When the soap is an alkaline metal salt of a long chain high molecular weight carboxylic acids, it will have a pH of about 10 even if there is no free titratable alkali present in the solid soap. It is known that the addition of an alcohol amine, such as triethanolamine, to a soap results in a substantially non-alkaline soap; a soap having a pH of 7.5 to 9.0 in 10 weight percent aqueous solution can be considered to be substantially non-alkaline.

To be commercially acceptable, a transparent soap must have good bar soap characteristics, such as lathering, firmness, hardness, mildness, minimum slushing, low background odor, and safety in use. The soap must keep its transparency under all types of aging conditions.

The present invention resides in the discovery that another class of amine can be used in formulating a substantially non-alkaline, solid transparent soap. Certain preferred ratios of components are critical, albeit different, as with formulations based on the use of triethanolamine.

Specifically, the particular amine class that is useful herein is a tetrakis (hydroxyalkyl) ethylene diamine having the formula:

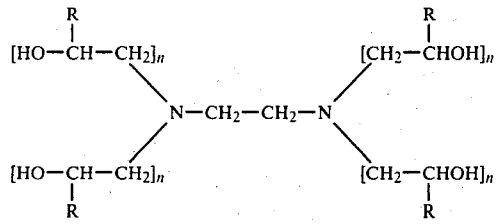

wherein R is hydrogen or an alkyl group having one to four carbon atoms and n is one to four. The foregoing diamine has a molecular weight of under 1700. It is combined with a transparent sodium soap prepared by saponification of fatty oil and a polyhydric alcohol as solvent.

More particularly, one mixes together caustic soda (i.e., sodium hydroxide), saponifiable fatty oil to react with the caustic soda to form a soap, water and a polyhydric alcohol. The diamine can be added before or after saponification. After saponification, one must add a superfatting agent, preferably one or more fatty acids of $C_{12}$-$C_{18}$, both fully saturated and unsaturated, straight or branched. Examples include stearic acid, oleic acid, isostearic acid, fatty acids derived from tallow oil or coconut oil, i.e. tallow fatty acid, hydrogenated tallow fatty acid, coconut fatty acid, and the like. Particularly preferred is stearic acid optionally with oleic acid. Other components are those adjuvants that are known to the art including: a humectant such as glycerine, foam boosters and stabilizers, surfactants, chelating compounds, and perfume. The saponifiable fatty oil is preferably a mixture of tallow, coconut oil and caster oil in certain defined ratios, as will be hereinafter described. The mixture is agitated and heated until it is well mixed.

DETAILED DESCRIPTION

Although other examples will also be given hereinafter, the tetrakis (hydroxyalkyl) ethylene diamine is best exemplified by the compound N,N,N',N'-tetrakis (2-hydroxypropyl)-ethylenediamine, obtainable commercially under the trademark Quadrol. This diamine constitutes the basis for the new transparent soap composition. It is combined at a concentration of about 5–20 weight percent with other ingredients, all of which have been used in other soap compositions for various purposes but it is found that it is necessary to use certain key components in combination with the diamine in order to successfully formulate a transparent soap having the desirable qualities described above.

One of the key components is a sodium soap prepared by the saponification of fatty oil. It is particularly preferred that the fatty oil comprise a mixture of tallow, coconut oil and castor oil. When tallow alone is used, a mild soap results but one that does not have the most desirable foaming characteristics. On the other hand, coconut oil provides superior foaming characteristics but when used alone, the resulting soap can be somewhat harsh. The castor oil component aids in promoting transparency by forming sodium ricinolates which serve to retard crystallization of the finished soap bar. A soap with optimum characteristics is produced when the castor oil component constitutes about 10–30 weight percent of the fatty oil mixture with the weight ratio of tallow to coconut oil being in the range of 50:50 to 85:15.

A soap is formed from the above mixture of fatty oils by saponification with caustic soda. The resultant soap is alkaline and is therefore not suitable for direct use as a mild toilet soap. The sodium soap thus prepared constitutes about 10–30 weight percent of the fully formulated transparent soap of this invention.

Next, one or more fatty acids are added to (a) neutralize the excess caustic soda and to (b) act as a superfatting agent. It has been found that a superior bar results when about 6 weight percent to about 16 weight percent, preferably 12–14 weight percent, of the final soap weight is a superfatting agent comprising stearic acid with up to 4 weight percent of oleic acid.

Another key component is a polyhydric alcohol which can serve as a solvent for the diamine and which is also a critical component to assure transparency. For example, one can use glycerine, or a glycol or the like. Particularly preferred is propylene glycol which serves not only as a solvent but also as a moisturizing agent in the final soap bar and is mild and safe to use on the skin. It will be appreciated that whereas propylene glycol has been used in prior soap formulations, its use has been primarily for its cosmetic values whereas its principal purpose in the present invention is to serve as a solvent for the diamine and to aid in providing transparency. In this regard, the diamine can be added either prior to saponification or after saponification, but in either case the saponification step should be carried out in the presence of the propylene glycol. The propylene glycol serves as a diluent to thin out the otherwise thick mixture of caustic soda and fatty oils.

Another important ingredient is water as the hardness and clarity of the finished bar is strongly dependent on its total moisture content. There are several sources of water in this formulation, e.g., in the caustic soda solution and as produced by the saponification reaction. Since it has been observed that more water must be added than is produced, the water content of the bar can be controlled by the addition of water to the bar during formulation. Generally, the addition of less than 6% total added (not formed in situ) water from all sources will usually result in a bar that is too hard and one that tends to form crystals on aging, i.e., lose clarity; more than about 15% will usually result in a bar that is too soft.

Various other ingredients, common to the cosmetic field, can be added, preferably after saponification, to create a finished bar suitable for consumer use. In this regard, about 4–10 weight percent of glycerine can be added, which performs as a humectant and moisturizer. A water soluble emollient or skin conditioner can be added, for example an alkoxylated lanolin such as that sold under the trademark Lanexol AWS. This particular emollient also has some superfatting properties.

It is also desirable to add one or more surfactants, in a range of about 5–10% by weight, to increase the foaming property of the soap. The choice of surfactant is important since it tends to affect the transparency and the foaming of the finished bar soap. Preferred are anionic or amphoteric surfactants, including amine oxides. Simple try-and-see experimentation will suffice to determine if a particular surfactant is suitable. It has been found that amine oxides are superior surfactants in this regard, for example lauric dimethylamine oxide. Still other components that can be added are foam boosters and foam stabilizers, such as lauric diethanolamide or coconut diethanolamide,. a chelating agent, such as ethylenediaminetetraacetic acid (EDTA) serving to chelate metal ions, such as iron, magnesium and other ions, present in hard water that would otherwise tend to combine with the tetrakis (hydroxyalkyl) ethylene diamine, or that would otherwise tend to form insoluble salts of the fatty acids, colors, antioxidants and perfumes.

In preparing the transparent soap of the present invention, the primary reaction is the saponification reaction between the caustic soda and the fatty oils in the presence of at least some of the polyhydric alcohol solvent. The tetrakis (hydroxyalkyl) ethylene diamine can be added prior to or during saponification, or can be added after saponification. Thus, in one mode of preparation, the tetrakis (hydroxyalkyl) ethylene diamine and propylene glycol are admixed with the fatty oil, the caustic soda and water. The mixture is then heated to a range of between 90° and 100° C., with agitation for a time sufficient to effect complete saponification. The time required ranges between ¼ hour and 3 hours, depending on such physical factors as size of bath and agitation. After saponification, the remaining ingredients can be added, good practice being to add the superfatting agent first and then the remaining ingredients, with the perfume last. The perfume is added last simply because it is the most volatile of the ingredients.

In an alternative procedure, the caustic soda and saponifiable fatty oils are heated together with the polyhydric alcohol as a solvent until saponification is complete. Thereafter, the tetrakis (hydroxyalkyl) ethylene diamine is added followed by the other ingredients as listed above. The result in each case is a transparent, hard soap composition that maintains transparency under extended aging conditions, has good bar soap characteristics, such as lathering, firmness, hardness, mildness to the skin, minimum slushing and low background odor, and is safe for consumer use. The following examples will further illustrate the invention.

EXAMPLES I–XV

The following formulations all provide suitable soap compositions in accordance herewith. In the formulations, components listed by trademark are identified as follows:

| MARK | SOLD BY | GENERIC |
|---|---|---|
| Lanexol AWS | Croda, Inc. 51 Madison Avenue New York, N.Y. 10010 | polyoxyethylene (50), polyoxypropylene (12), Alkoxylated lanolin |
| Hampene | W. R. Grace & Co. (Hampshire) Nashua, N.H. 03060 | ethylenediamine-tetraacetic acid |
| Carsamide CA | Quad Chemical Corp. 2779 E. El Presidio Long Beach, CA 90810 | Cocamide DEA |
| Ammonyx LO | Onyx Chemical Co. Div. Millmaster Oxyx Corp. 710 Wilshire Blvd., S. 312 Santa Monica, CA 90401 | Lauryl Dimethyl amixe oxide |
| Chemadene NA-30 | Richardson Chemical Co. 1250 N. Main St. Los Angeles, CA 90012 | Coco-Amido propyl betaine |
| Solulan 98 | Amerchol Corp. Affiliate of CPC International, Inc. P. O. Box 351 Talmadge Rd. Edison, N.J. 08817 | Acetylated polyoxyethelene derivative, lanoline (10 moles of EO) |
| Acyl-glutamate HS-21 | Ajinomoto USA, Inc. 700 S. Flower St. Los Angeles, CA 90017 | Disodium salt of Acylghetamate (Acyl radical) is a mixture of cocoyl and tallowyl |

-continued

| MARK | SOLD BY | GENERIC |
|---|---|---|
| Igepon TC-42 | GAF Corp. 525 E. Imperial Highway La Habra, CA 90631 | Sodium N-coconut acid-N-methyl Taurate |

The mixed tocopherols serve as antioxidants. The Neo-Prucellin Prime is obtainable from Dragoco, Inc., 10960 Wilshire Boulevard, Suite 904, Los Angeles, Calif. 90024.

| | % by weight | | | |
|---|---|---|---|---|
| | I | II | III | IV |
| Propylene glycol | 19.5 | 19.5 | 19.5 | 19.5 |
| Quadrol | 10.0 | 10.0 | 10.0 | 10.0 |
| Castor oil | 4.5 | 4.5 | 4.5 | 4.5 |
| Tallow | 8.3 | 8.3 | 8.3 | 10.5 |
| Coconut oil | 8.3 | 8.3 | 8.3 | 6.1 |
| Caustic soda, 50% | 8.3 | 8.3 | 8.3 | 8.1 |
| Stearic acid | 13.1 | 10.0 | 10.0 | 10.0 |
| Oleic acid | — | 3.1 | 3.0 | 3.1 |
| Lauric diethanolymide | 6.0 | 1.8 | 5.0 | 1.8 |
| Glycerine | 8.9 | 8.9 | 5.0 | 8.9 |
| Lauric dimethylamine oxide | 2.6 | 10.0 | 5.0 | 10.0 |
| Lanexol AWS | 3.0 | 0.0 | 3.0 | 0.0 |
| Hampene 100 (EDTA) | 1.0 | — | — | — |
| Fragrance | — | 0.7 | 0.5 | 0.6 |
| Antioxidant | 0.1 | 0.1 | 0.1 | 0.1 |
| Deionized water | 10.65 | 6.6 | 9.6 | 6.9 |

| | % by weight | | | | |
|---|---|---|---|---|---|
| | V | VI | VII | VIII | IX |
| Propylene Glycol | 19.50 | 19.50 | 19.50 | 19.50 | 19.50 |
| Castor Oil | 4.50 | 4.50 | 4.50 | 4.50 | 4.50 |
| Coconut Oil | 6.10 | 8.30 | 6.10 | 8.30 | 8.30 |
| Tallow | 10.50 | 8.30 | 10.50 | 8.30 | 8.30 |
| Caustic | 8.10 | 8.20 | 8.10 | 8.30 | 8.30 |
| Quadrol | 21.00 | 21.00 | 20.00 | 10.00 | 10.00 |
| Oleic Acid | 3.10 | 3.10 | 3.10 | 3.10 | 3.10 |
| Stearic Acid | 8.00 | 12.00 | 14.00 | 10.00 | 10.00 |
| Carsamide CA | 1.80 | 1.80 | 1.80 | — | 1.82 |
| Glycerine | 5.50 | 5.50 | 8.00 | 5.50 | 8.90 |
| Ammonyx LO | — | — | — | — | 5.00 |
| Lanexol AWS | — | — | — | — | 3.00 |
| Water | 11.90 | 7.80 | 6.90 | 10.50 | 8.40 |
| Chemadene NA-30 | — | — | — | 5.00 | — |
| Fragrance | — | — | — | 0.70 | — |

| | % by weight | | | |
|---|---|---|---|---|
| | X | XI | XII | XIII |
| Quadrol | 10.00 | 10.00 | 10.00 | 10.00 |
| Propylene Glycol | 19.50 | 19.50 | 19.50 | 19.50 |
| Castor Oil | 4.50 | 4.50 | 4.50 | 4.50 |
| Coconut Oil | 8.30 | 8.30 | 8.30 | 8.30 |
| Tallow | 8.30 | 8.30 | 8.30 | 8.30 |
| Caustic | 8.30 | 8.30 | 8.30 | 8.30 |
| Water | 1.90 | 1.40 | 4.50 | 3.60 |
| Oleic Acid | 3.10 | — | 3.10 | 3.10 |
| Stearic Acid | 10.00 | 13.10 | 10.00 | 10.00 |
| Carsamide CA | 6.00 | 6.00 | 6.00 | — |
| Glycerine | 8.90 | 8.90 | 5.00 | 8.90 |
| Ammonyx LO | 6.50 | 6.50 | 6.50 | 6.50 |
| Lanexol AWS | 1.50 | 3.00 | 3.00 | 3.00 |
| Hampene 100 | — | 1.00 | — | — |
| Neo-Prucellin Prime | 1.00 | — | — | — |
| Mixed Tocopherols | — | 0.50 | — | — |
| Solulan 98 | 1.50 | — | — | — |
| Fragrance | 0.70 | 0.70 | — | — |
| Acylglutamate HS-21 | — | — | 3.00 | — |
| Igepon TC-42 | — | — | — | 5.00 |

| | % by weight | |
|---|---|---|
| | XIV | XV |
| Propylene Glycol | 15.50 | 15.50 |
| Hexylene Glycol | 4.00 | 4.00 |
| Quadrol | 9.00 | 10.00 |
| Castor Oil | 4.50 | 4.50 |
| Coconut Oil | 8.30 | 8.30 |
| Tallow | 8.30 | 8.30 |
| Caustic Soda | 8.30 | 8.30 |
| Deionized Water | 3.90 | 2.90 |
| Oleic Acid | 3.10 | 3.10 |
| Stearic Acid | 10.00 | 10.00 |
| Glycerine | 8.90 | 8.90 |
| Ammonyx LO | 6.50 | 6.50 |
| Carsamide CA | 6.00 | 6.00 |
| Lanexol AWS | 3.00 | 3.00 |
| Fragrance | 0.70 | 0.70 |

EXAMPLE XVI

To a mixture of 85 ml 50% sodium hydroxide and 100 grams of N,N,N',N'-tetrakis (2-hydroxypropyl)-ethylene diamine in 195 grams of propylene glycol are added 45 grams of castor oil, 83 grams of coconut oil and 83 grams of tallow. The mixture is heated, with mechanical agitation, to 100° C. for 60 minutes. Then 31 grams of oleic acid and 100 grams of stearic acid are added to the mixture. Thereafter, one ingredient at a time are added of 18 grams of lauric diethanolamide, 89 grams of glycerine, 100 grams of lauric dimethylamine oxide (40% active), 7 grams of perfume and 66 ml of water. The mixture is allowed to solidify by cooling and is then cut into bars suitable for toilet use. A 10% solution of the soap has a pH of about 8.8. Hardness, determined using a Precision Scientific Penetrometer, with 1/10 mm division, 150 grams weight, is found to be 105.

EXAMPLES XVII-XX

Example V can be repeated with an equivalent weight amount of the following diamines as a substitute for the N,N,N',N'-tetrakis (2-hydroxypropyl) ethylenediamine of Example V:

$(HOCH_2CH_2)_2NCH_2CH_2N(CH_2CH_2OH)_2$ Ex. XVII $[(HOC(C_4H_9)H_2CH_2OC(C_4H_9)H_2CH_2OC(C_4H_9)H_2CH_2OC(C_4H_9)H_2CH_2)_2NCH_2]_2$ Ex. XVIII $[(HOCH_2CH_2OCH_2CH_2OCH_2CH_2OCH_2CH_2)_2NCH_2]_2$ Ex. XIX $(HOC(C_4H_9)H_2CH_2)_2NCH_2CH_2N(CH_2C(C_4H_9)H_2OH)_2$ Ex. XX

In each instance a transparent solid bar of toilet soap with a substantially non-alkaline pH suitable for toilet use can be produced.

EXAMPLE XXI

A combination of 45 grams of castor oil, 105 grams of tallow, 61 grams of coconut oil and 195 grams of propylene glycol are mixed with a 50% concentrated aqueous alkaline solution containing 40.5 grams of sodium hydroxide. The mixture is heated for 90 minutes at 100° C. with agitation. After saponification is completed 100 grams of N,N,N',N'-tetrakis (2-hydroxypropyl) ethylenediamine and 131 grams of stearic acid are added and thoroughly mixed with the saponified soap mixture. 18 grams of lauric diethanolamide, 89 grams of glycerine, 100 grams of lauric dimethylamine oxide (40%) and 6 grams of perfume are added and mixed in the order listed. The mixture is then cast in the form of bars and allowed to cool. The resulting transparent bars have a substantially non-alkaline pH and are suitable for toilet use.

We claim:

1. A transparent, low alkalinity soap composition in solid form, comprising:

about 10–30 weight percent of a sodium soap prepared by saponification of fatty oils;

about 5–20 weight percent of a tetrakis (hydroxyalkyl) ethylene diamine having the formula

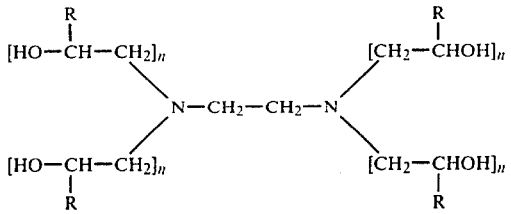

wherein R is hydrogen or an alkyl group having one to four carbon atoms and n is one to four;

a polyhydric alcohol in an amount sufficient to assure transparency; and a fatty acid superfatting agent.

2. The composition of claim 1 in which said superfatting agent comprises stearic acid.

3. The composition of claim 2 in which a minor portion of said superfatting agent comprises oleic acid.

4. The composition of claim 1 in which said fatty oil is a mixture of tallow, coconut oil and castor oil.

5. The composition of claim 4 in which said castor oil constitutes about 10–30 weight percent of said fatty oil mixture and the weight ratio of tallow to coconut oil is about 50:50 to 85:15.

6. The composition of claim 1 including added water.

7. The composition of claim 1 including an anionic or amphoteric surfactant.

8. The composition of claim 7 in which said surfactant is lauric dimenthylamine oxide.

9. The composition of any one of claims 1–8 in which said polyhydric alcohol comprises propylene glycol.

10. The composition of any one of claims 1–7 in which said diamine is N,N,N′,N′-tetrakis (2-hydroxypropyl)-ethylenediamine.

11. The composition of claim 10 in which said polyhydric alcohol is propylene glycol.

12. A transparent soap composition in solid form comprising:

about 10–30 weight percent of a sodium soap prepared by saponification of a mixture of tallow, coconut oil and castor oil, said castor oil comprising about 10 to about 30 weight percent of said misture, the weight ratio of tallow to coconut oil being about 50:50 to about 85:15;

about 5–20 weight percent of N,N,N′,N′-tetrakis (2-hydroxypropyl)-ethylenediamine;

about 10–40 weight percent of propylene glycol as solvent for said diamine;

about 6–16 weight percent of superfatting agent comprising stearic acid;

about 5–10 weight percent of an anionic or amphoteric surfactant; and about 6–15 weight percent of added water.

13. The composition of claim 12 in which said superfatting agent is present in a range of about 12–14 weight percent and comprises up to 4 percent of oleic acid.

14. The composition of claim 12 or 13 including a small amount of glycerin as a humectant.

15. A method for the preparation of a transparent soap composition in solid form, comprising:

bringing together sodium hydroxide solution, saponifiable fatty oil to react with said sodium hydroxide to form a sodium soap constituting about 10–30 weight percent of the transparent soap composition, a tetrakis (hydroxyalkyl) ethylene diamine constituting about 5–20 weight percent of the transparent soap composition, a polyhydric alcohol in an amount sufficient to assure transparency and water;

saponifying said fatty oil with said sodium hydroxide; and adding to said saponified mixture a fatty and superfatting agent.

16. The method of claim 15 in which said superfatting agent comprises stearic acid.

17. The method of claim 16 in which a minor portion of said superfatting agent comprises oleic acid.

18. The method of claim 15 in which said superfatting agent is selected from one or more fatty acids derived from tallow oil or coconut oil.

19. The method of claim 15 in which said fatty oil is a mixture of tallow, coconut oil and castor oil.

20. The method of claim 19 in which said castor oil constitutes about 10–30 weight percent of said fatty oil mixture and the weight ratio of tallow to coconut oil is about 50:50 to 85:15.

21. The method of claim 15 in which water is added to said saponification mixture prior to said saponification step.

22. The method of any one of claims 15–21 in which said polyhydric alcohol comprises propylene glycol.

23. The method of any one of claims 15–21 in which said diamine is N,N,N′,N′-tetrakis (2-hydroxypropyl)-ethylene-diamine.

24. The method of claim 23 in which said polyhydric alcohol is propylene glycol.

25. A method for the preparation of a transparent soap composition in solid form, comprising:

mixing together sodium hydroxide, saponifiable fatty oil to react with said sodium hydroxide to form a sodium soap constituting about 10–30 weight percent of the transparent soap composition, polyhydric alcohol in an amount sufficient to assure transparency, and water;

saponifying said fatty oil with said sodium hydroxide;

thereafter adding to said mixture a tetrakis (hydroxyalkyl) ethylene diamine constituting about 10–30 weight percent of the transparent soap composition; and adding to said saponified mixture a fatty acid superfatting agent.

26. The method of claim 25 in which said superfatting agent is stearic acid.

27. The method of claim 26 in which a minor portion of said superfatting agent comprises oleic acid.

28. The method of claim 25 in which said fatty oil is a mixture of tallow, coconut oil and castor oil.

29. The method of claim 28 in which said castor oil constitutes about 10–30 weight percent of said fatty oil mixture and the weight ratio of tallow to coconut oil is about 50:50 to 85:15.

30. The mixture of claim 25 in which water is added to the mixture prior to said saponification.

31. The method of any one of claims 25–30 in which said polyhydric alcohol comprises propylene glycol.

32. The method of any one of claims 25–30 in which said diamine is N,N,N′,N′-tetrakis(2-hydroxypropyl) ethylenediamine.

33. The method of claim 32 in which said polyhydric alcohol is propylene glycol.

34. The method of any one of claims 25–30 in which said polyhydric alcohol is present during the saponification step.

* * * * *

UNITED STATES PATENT AND TRADEMARK OFFICE

CERTIFICATE OF CORRECTION

PATENT NO. : 4,290,904

DATED : September 22, 1981

INVENTOR(S) : Maxwell H. Poper

It is certified that error appears in the above-identified patent and that said Letters Patent are hereby corrected as shown below:

In column 7, line 47, delete "misture" and substitute --mixture--.

In column 7, line 59, after "4" insert --weight--.

Signed and Sealed this

Second Day of March 1982

[SEAL]

Attest:

GERALD J. MOSSINGHOFF

Attesting Officer

Commissioner of Patents and Trademarks